US006082574A

United States Patent [19]

Johnson

[11] Patent Number: 6,082,574

[45] Date of Patent: Jul. 4, 2000

[54] COLLECTION APPARATUS

[76] Inventor: Samuel V. Johnson, 324 W. Parkwood Dr., Decatur, Ga. 30030

[21] Appl. No.: 09/146,027

[22] Filed: Sep. 3, 1998

[51] Int. Cl.[7] ..... B65F 1/06

[52] U.S. Cl. ..... 220/495.1; 220/23.91; 220/908.3; 220/908.1

[58] Field of Search ..... 220/908, 908.3, 220/908.1, 23.91, 495.06, 495.08, 495.1

[56] References Cited

U.S. PATENT DOCUMENTS

| | | | |
|---|---|---|---|
| 3,191,798 | 6/1965 | White et al. | 220/908.3 |
| 3,734,340 | 5/1973 | Ippolito et al. . | |
| 4,154,387 | 5/1979 | Booth et al. . | |
| 4,200,127 | 4/1980 | Dunleavy . | |
| 4,248,278 | 2/1981 | Blodgett . | |
| 4,338,979 | 7/1982 | Dow . | |
| 4,357,728 | 11/1982 | Pravettone . | |
| 4,442,567 | 4/1984 | Pravettone . | |
| 4,470,627 | 9/1984 | Carroll et al. . | |
| 4,714,168 | 12/1987 | Johnson et al. | 220/502 |
| 4,795,046 | 1/1989 | Rath . | |
| 4,802,258 | 2/1989 | Jensen . | |
| 5,031,277 | 7/1991 | Coker . | |
| 5,048,778 | 9/1991 | Wright . | |
| 5,387,735 | 2/1995 | Ponsi et al. | 220/908 |
| 5,624,050 | 4/1997 | Haas | 220/4.05 |

*Primary Examiner*—Stephen Castellano
*Attorney, Agent, or Firm*—Schmeiser, Olsen & Watts

[57] ABSTRACT

A collection apparatus for gathering loose material, comprising a main body and a scoop funnel configured to direct material into, and entrap material within, the main body. The main body generally includes a collection bin for supporting at least one collection bag. Bag clamping flaps are provided to hold the mouth of the collection bag in an open position.

20 Claims, 13 Drawing Sheets

COLLECTION APPARATUS

FIELD OF THE INVENTION

The present invention relates generally to the gathering of soil, mulch, leaves, and other yard waste. More particularly, the present invention provides an apparatus for gathering loose material comprising a main body for collecting the loose material, and a unique funnel for directing the loose material into the main body.

BACKGROUND OF THE INVENTION

Any number of containers, collectors, and transporters for gathering material such as garbage, leaves, mulch, grass clippings and the like have been suggested and commercialized in the past. Several of these devices even include a funnel or similar structure for facilitating the passage of the material into a container. Unfortunately, such prior art collection devices suffer from many shortcomings. For example, prior art collection devices do not include a device to entrap the collected material within the container after the material has been directed past the funnel. Often, when it is windy, previously collected material will blow out of the container. Also, as the container fills, the previously collected material tends to easily spill out of the container when the container is in a horizontal collection position. Prior art collection devices also fail to provide means for simultaneously filling multiple bags or bins using a funnel apparatus, means for nesting multiple collection devices, or means for collapsing the collection device for convenient storage.

SUMMARY OF THE INVENTION

In order to overcome the above deficiencies, the present invention provides a collection apparatus for gathering loose material, comprising a main body and a scoop funnel configured to direct material into, and entrap material within, the main body. The main body generally includes a solid walled collection bin or a rigid frame support for holding a solid walled collection bin. The rigid frame support may additionally be used to support at least one collection bag made of paper, cardboard, plastic, webbing, or other suitable material. Wheels may be attached to the main body to facilitate mobility of the collection apparatus. A main body handle may be provided on the main body for lifting and propelling the collection apparatus, and for facilitating the rotation of the collection apparatus from a vertical to a horizontal position or vice versa. Also, bag clamping flaps may be provided to conveniently hold the mouth of the collection bag in an open position within the main body.

In the preferred embodiment of the present invention, the main body includes a rigid frame support that supports a solid walled collection bin in which a large paper or plastic collection bag may be placed. A plurality of bag clamping flaps, pivotally mounted about the top of the collection bin, are provided to maintain the mouth of the collection bag in an open position. As an option, the collection bag can be omitted and material can be collected directly in the solid walled collection bin. A scoop funnel is provided to direct material into, and entrap material within the collection bag or, if a collection bag is not used, directly within the collection bin.

In operation, the outlet of the scoop funnel is placed inside the mouth of the collection bin. If a collection bag is used, the scoop funnel outlet is inserted into the mouth of the collection bag positioned within the collection bin. The scoop funnel comprises a wide mouth funnel inlet on one end and a funnel outlet on an opposite end that fits inside the mouth of the collection bin. The funnel outlet includes a plurality of sealing flaps that prevent spillage from around the peripheral edge of the collection bin and/or bag, and a plurality of entrapment flaps that entrap collected material in the collection bag to prevent the collected material from escaping from the mouth of the collection bin and/or bag.

A main body handle is provided as part of the rigid frame support. The main body handle may be used to facilitate movement of the collection apparatus as it is rolled from one location to another, and to facilitate the rotation of the apparatus from a vertical to a horizontal position or vice versa. In addition, elements of the rigid frame support can be grasped to facilitate movement of the collection apparatus. Two wheels are fastened to the main body in a manner such that the wheels contact the ground when the main body is in a vertical position and leave the ground when the main body is in a horizontal position. This arrangement prevents the main body from moving when material is raked, swept, or otherwise directed into the collection apparatus.

A further embodiment of the scoop funnel includes a plurality of spillage prevention flaps that are designed to be inserted into the mouth of the collection bag supported within the collection bin, or directly within the collection bin if a collection bag is not used. This scoop funnel is surrounded by a handle that allows the scoop funnel to be easily grasped from any side during the insertion or removal of the scoop funnel from the collection bin.

Another embodiment of the collection apparatus comprises a collection bin with a scoop funnel pivotally attached to a top support bar. The scoop funnel may be selectively pivoted between a first loading position, wherein the scoop funnel is used to load material into a collection bag, and a second position to allow for the insertion or removal of the collection bag from the collection bin.

A further embodiment of the collection apparatus includes a collapsible collection bin which is designed to hold a collection bag. As in the previously described embodiments of the present invention, a scoop funnel can be placed in the opening of the collection bag to facilitate loading. For storage, the collapsible collection bin can be folded flat after removal of the scoop funnel.

In yet another embodiment, the present invention provides a main body comprising a solid walled collection bin with compact storage features. Loose material such as dirt or mulch can be scooped into the collection bin and the collection bin can be dragged much like a sled from one location to another using a main body handle. The main body handle can be removed from the solid walled collection bin to allow multiple solid walled collection bins to be nested or stacked together for storage, shipping, etc.

Another embodiment of the collection apparatus is configured to simultaneously hold two collection bags in the solid walled collection bin. A support frame including two joined funnels is pivotally attached to a top portion of the collection bin. Each of the two joined funnels is designed to direct material into a respective one of the collection bags. To insert the collection bags into the collection bin, the support frame and funnels are pivoted in an upward direction away from the mouth of the collection bin. After placing the collection bags within the collection bin, the support frame and funnels are pivoted in a downward direction until the outlets of the funnels extend into the mouths of the collection bags.

BRIEF DESCRIPTION OF THE DRAWINGS

The features of the present invention will best be understood from a detailed description of the invention and a preferred embodiment thereof selected for the purposes of illustration and shown in the accompanying drawings in which.

DETAILED DESCRIPTION OF THE INVENTION

Figure 1:
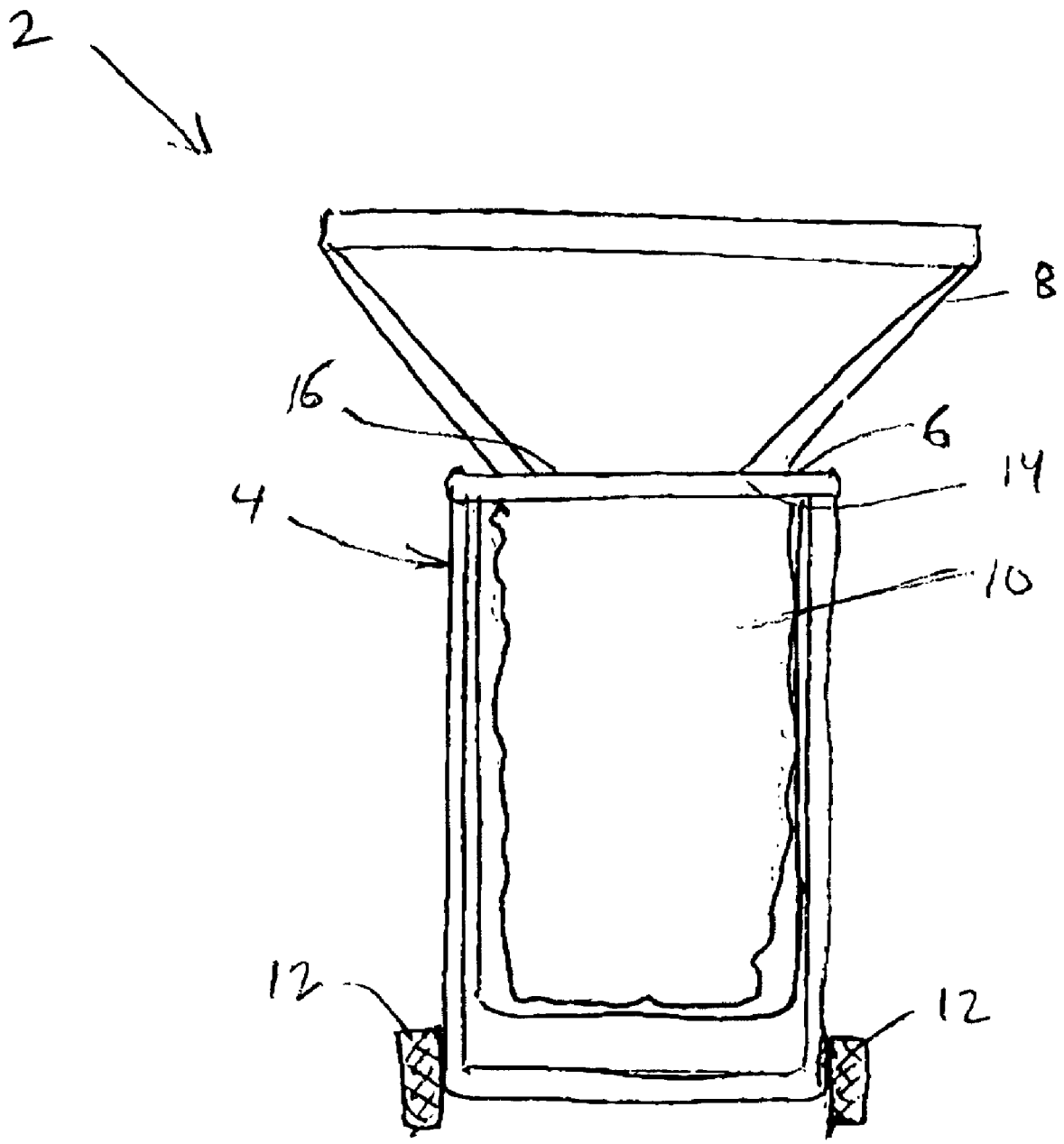
FIG. 1 is a front elevational view of a collection apparatus in accordance with a first, preferred embodiment the present invention.

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of the preferred embodiment. The features and advantages of the present invention are illustrated in detail in the accompanying drawings, wherein like reference numerals refer to like elements throughout the drawings.

Referring to FIG. 1, there is illustrated a front elevational view of a collection apparatus 2 in accordance with a first, preferred embodiment the present invention. The collection apparatus 2 generally comprises a main body 4 having a top opening 6. A scoop funnel 8 can be inserted within the top opening 6 to direct material into the main body 4. A collection bag 10 can be placed in the main body 4. If the collection bag 10 is present, an outlet of the scoop funnel 8 is inserted into the mouth 16 of the collection bag 10 to direct material into the collection bag 10. Wheels 12 may be attached to a lower portion of the main body 4 to facilitate movement of the collection apparatus 2 from one location to another. A main body handle 14 may also be provided to rotate the collection apparatus 2 between a horizontal and vertical position.

Figure 2:
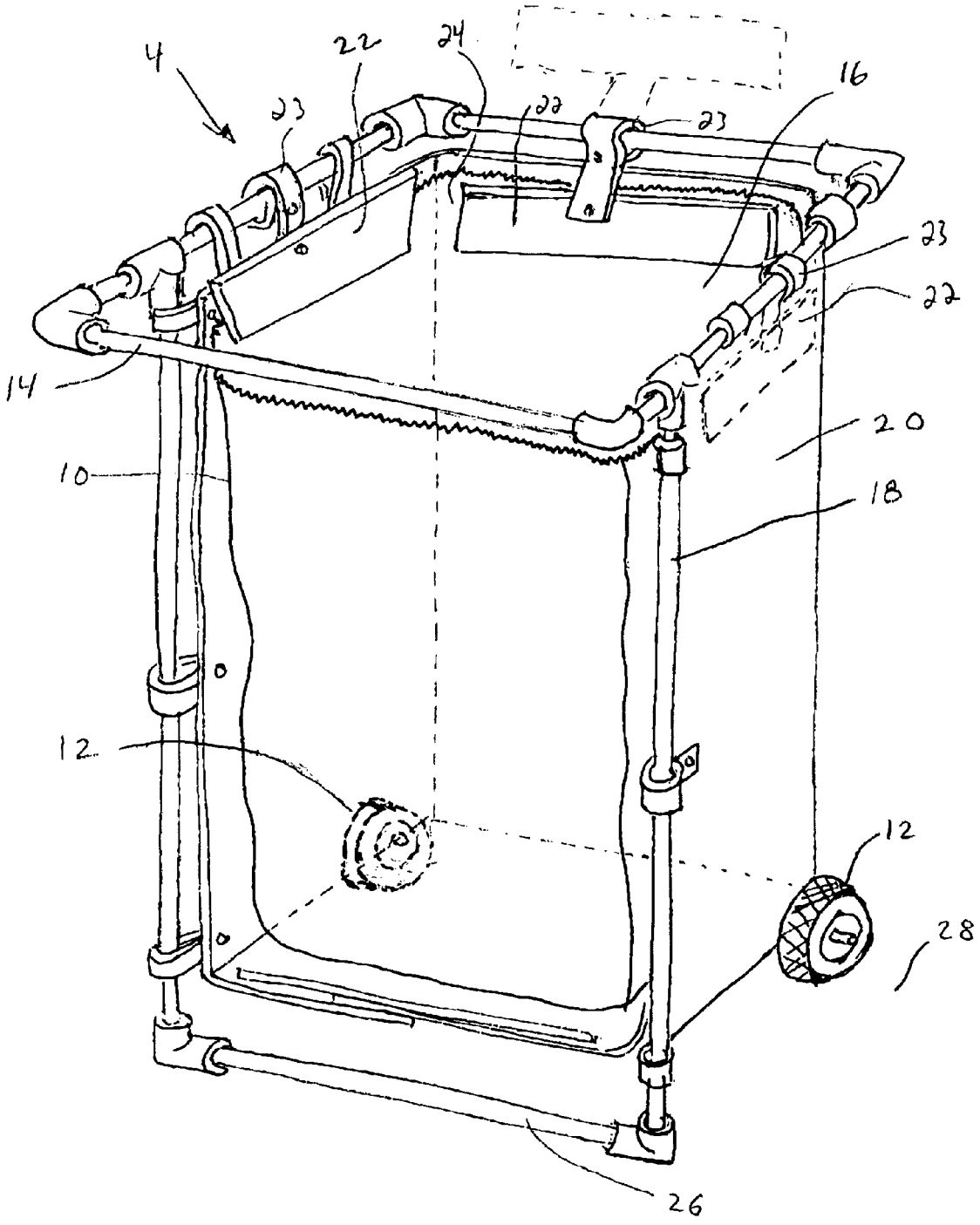
FIG. 2 is a perspective view of the main body of the collection apparatus of FIG. 1, wherein a collection bag is supported within the collection bin of the main body.

FIG. 2 is a perspective view of the main body 4 of the collection apparatus 2 of FIG. 1, with a collection bag 10 positioned within the main body 4. The main body 4 comprises a rigid frame support 18 for supporting a solid walled collection bin 20 and a plurality of bag clamping flaps 22. Attachments 23 are provided to pivotally secure the bag clamping flaps 22 to the rigid frame support 18. The wheels 12 are attached to a bottom portion of the collection bin 20. The main body handle 14 is attached to, and extends outward from, the rigid frame support 18. Although the collection bin 20 is illustrated as having an open front to facilitate the insertion and removal of a collection bag 10, a closed front may alternately be provided (for use with or without a collection bag). This also applies to the additional embodiments of a collection apparatus described below.

The collection bag 10 is placed in the solid walled collection bin 20, with the bottom of the collection bag 10 resting on the bottom of the collection bin 20. The top portion 24 of the collection bag 10 is clamped between the plurality of bag clamping flaps 22 and an interior top portion of the collection bin 20. The bag clamping flaps 22 can be pivoted between a first clamping position as illustrated in FIG. 2, wherein the mouth 16 of the collection bag 10 is maintained in an open state, and a second release position as shown in phantom to allow the collection bag 10 to be removed from the top or open front of the collection bin 20. When the main body 4 is in an upright position as shown, a bottom frame member 26 of the rigid frame support 18 and the two wheels 12 are in contact with the ground 28.

Figure 3:
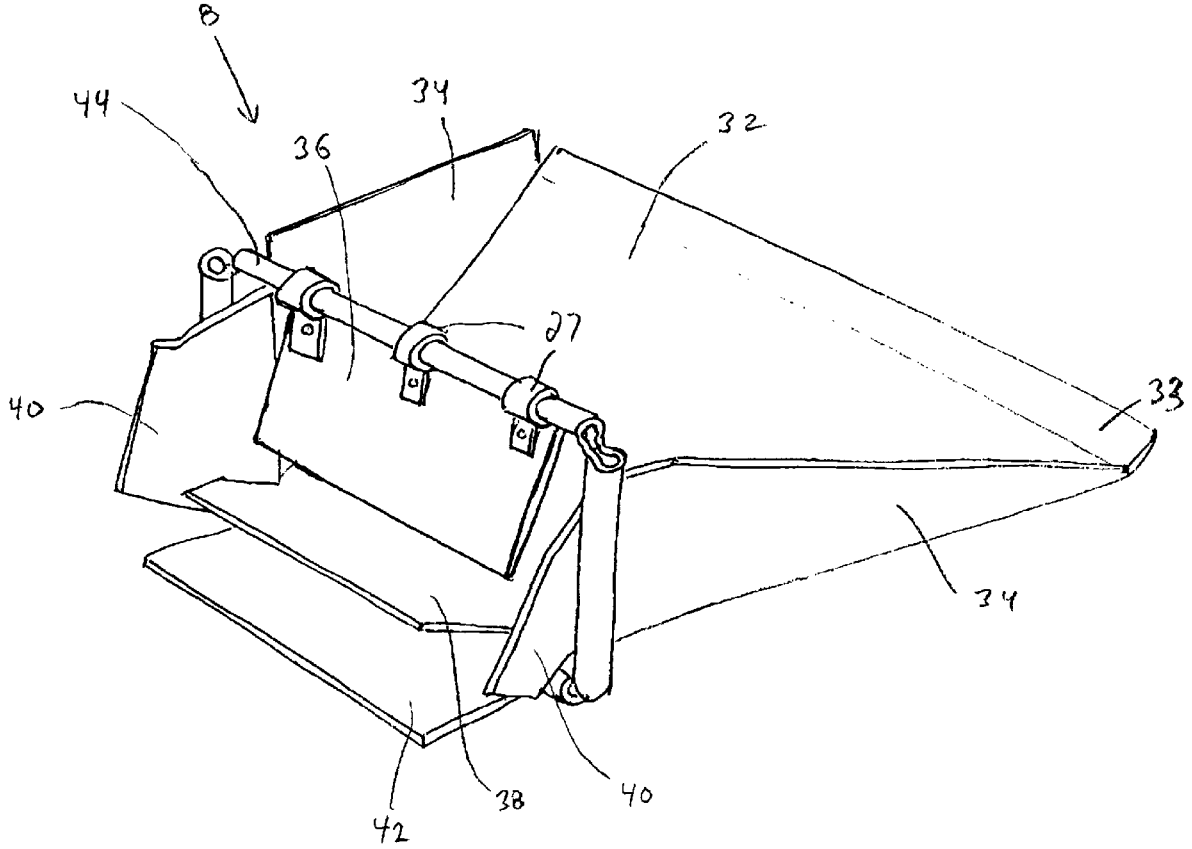
FIG. 3 is a perspective view of a first embodiment of a scoop funnel for use with the collection apparatus of FIG. 1.

As previously described, a scoop funnel 8 may be inserted into the top opening 6 of the main body 4 and, if a collection bag 10 is present, into the mouth 16 of the collection bag 10, to direct material into the collection apparatus and to prevent the collected material from escaping from the collection apparatus. A perspective view of a first embodiment of a scoop funnel 8 is illustrated in detail in FIG. 3. As shown, the scoop funnel 8 includes a wide mouth funnel inlet 32 having a ramped scoop lip 33, a pair of opposing funnel side walls 34, a pivoting upper entrapment flap 36, a bottom entrapment flap 38, a pair of side sealing flaps 40, a bottom sealing flap 42, and a funnel support frame/handle 44 for supporting the components of the scoop funnel 8. The pivoting upper entrapment flap 26 is pivotally secured to the funnel support frame/handle 44 by attachments 27.

Figure 4:
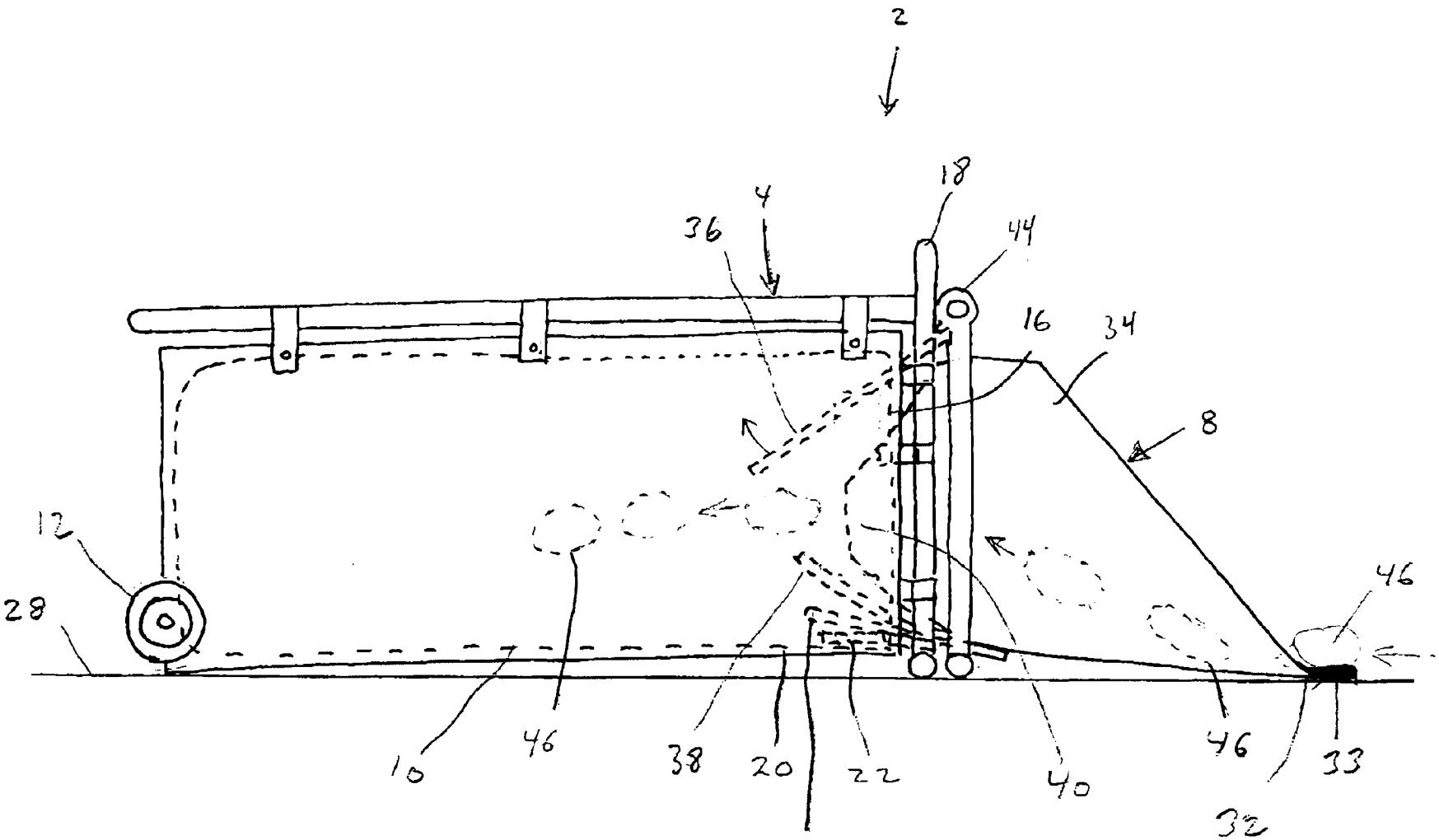
FIG. 4 is a side elevational view of the collection apparatus of FIG. 1, wherein the collection apparatus is positioned in a horizontal orientation, illustrating the collection of material within the collection apparatus and the function of the scoop funnel of FIG. 3.

FIG. 4 a side elevational view of the collection apparatus 2, wherein the collection apparatus 2 is positioned in a horizontal orientation, and wherein the scoop funnel 8 is inserted into the mouth 16 of a collection bag 10 installed in the collection bin 20. When the scoop funnel 8 is positioned in this manner, the pivoting upper entrapment flap 36, bottom entrapment flap 38, side sealing flaps 40, and bottom sealing flap 42 extend into the interior of the collection bag 10, thereby preventing collected material 46 from escaping from the collection apparatus 2. It should be noted that the scoop funnel 8 may be used in conjunction with the collection apparatus 2 with or without a collection bag 10. The collection apparatus 2 may be lifted by simultaneously grasping the rigid frame support 18 and the funnel support frame/handle 44.

The wide mouth funnel inlet 32 facilitates the insertion of material 46 to be collected into the collection apparatus 2. The ramped scoop lip 33 of the funnel inlet 32 contacts the ground 28 and further facilitates the gathering of material 46.

As shown in FIG. 4, as material 46 is directed into the collection bag 10, the pivoting upper entrapment flap 36 pivots in an upward direction to allow the material 46 to freely enter the collection bag 10. After the material 46 has entered the collection bag 10, the pivoting upper entrapment flap 36 automatically pivots downward due to gravity against the bottom entrapment flap 38, thereby entrapping the material 46 within the collection bag 10. The side sealing flaps 40 and bottom sealing flap 42 serve to prevent leakage of the collected material 46 from the sides and bottom of the collection bin 20. As shown in greater detail in FIG. 5, the pivoting upper entrapment flap 36 and bottom entrapment flap 38 serve to entrap the collected material 46 within the collection bin 20 by preventing the collected material 46 from escaping from the mouth 16 of the collection bag 10. The operation of the side sealing flaps 40, bottom sealing flap 42, and bottom entrapment flap 38 are illustrated in greater detail in FIG. 5.

Figure 5:
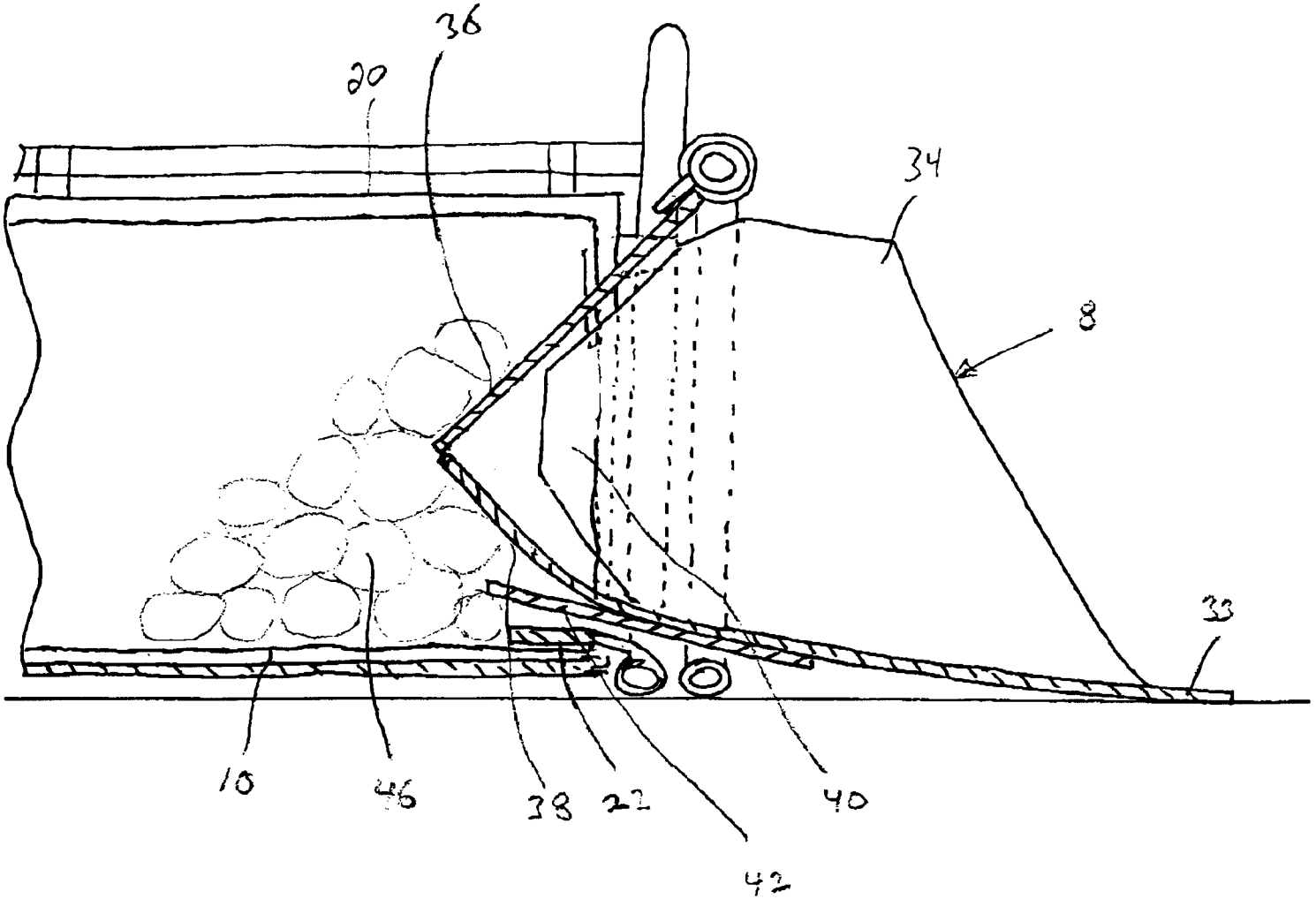
FIG. 5 is a partial cross-sectional view of FIG. 4, illustrating the operation of the entrapment flaps of the scoop funnel.

In FIG. 5, the collection bag 10 has been substantially filled with the collected material 46. The collected material 46 imparts a downward force against the top surface of the pivoting upper entrapment flap 36, thereby sealing the pivoting upper entrapment flap 36 against the bottom entrapment flap 38, and preventing the collected material 46 from escaping the collection bag 10. The full collection bag 10 can be subsequently removed from the collection apparatus 2 after rotation of the collection apparatus 2 to a vertical position.

When the collection apparatus 2 is positioned in a vertical position, and the scoop funnel 8 is inserted into the collection bin 20, the pivoting upper entrapment flap 36 automatically pivots downward into the collection bin due to gravity. In this position, the pivoting upper entrapment flap 36 does not interfere with the vertical loading of the collection bin 20.

Referring again to FIG. 4, it should be noted that the wheels 12 are attached to the collection bin 20 of the main body 4 at a location such that when the collection apparatus 2 is in a horizontal position, the wheels 12 are not in contact with the ground 28. Accordingly, since the wheels 12 are not in contact with the ground 28, the collection apparatus 2 is more stable and is less likely to move during collection of material. However, as shown in FIG. 2, the wheels 12 are in contact with the ground when the collection apparatus 2 is in a vertical position, thereby allowing the collection apparatus 2 to be easily rolled from location to location. The wheels 12 are also in contact with the ground whenever the collection apparatus 2 is angled (e.g., 45°) with respect to the ground.

Figure 6:
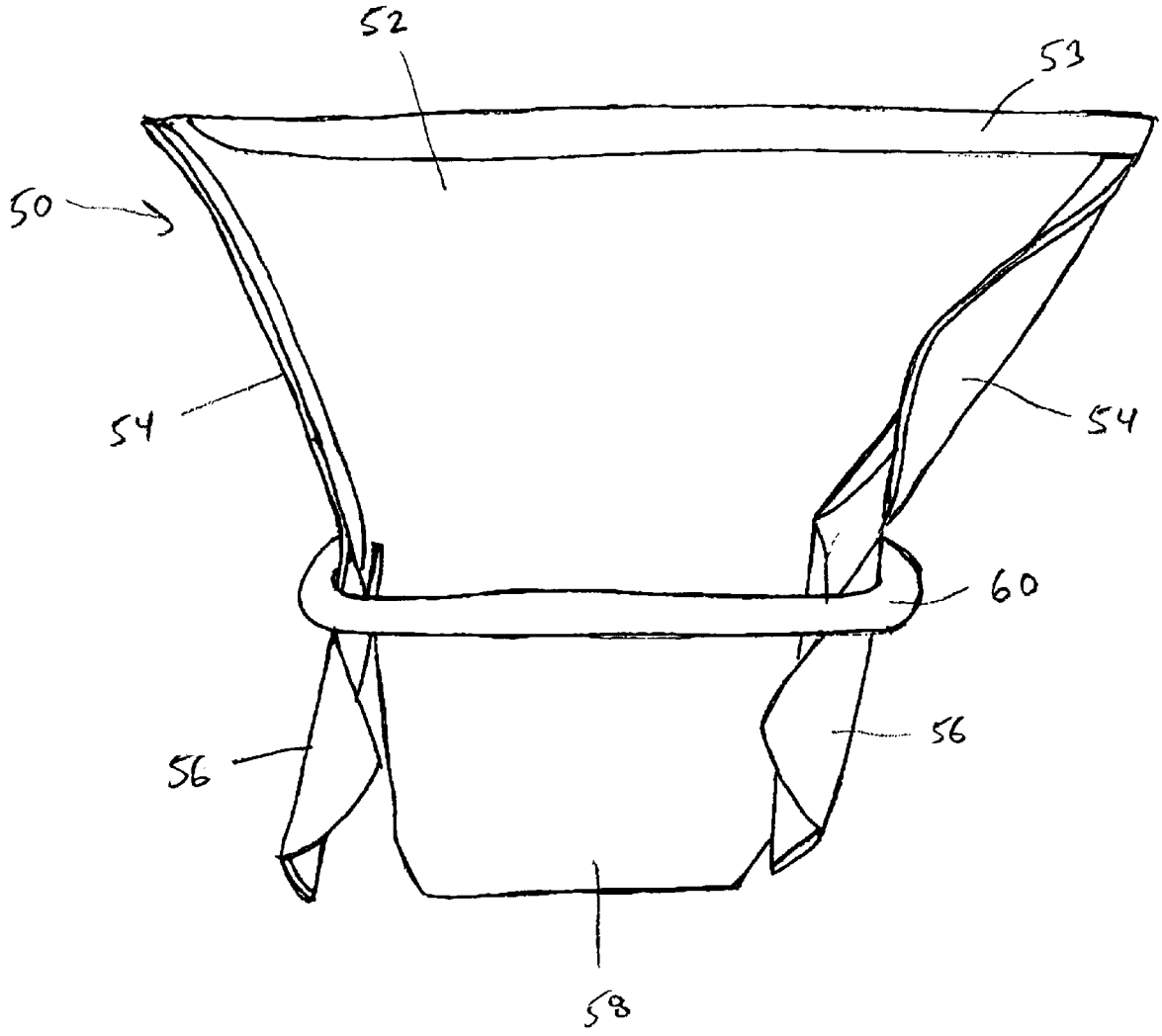
FIG. 6 is a perspective view of another embodiment of a scoop funnel for use with the present invention, wherein the scoop funnel contains three sealing flaps.

FIG. 6 is a perspective view of another embodiment of a scoop funnel 50 for use with the collection apparatuses of the present invention. The scoop funnel 50 includes a wide mouth funnel inlet 52 having a ramped scoop lip 53 and a pair of opposing funnel side walls 54. A pair of side sealing flaps 56 and a bottom sealing flap 58 are provided to prevent collected material from escaping from the collection bin or bag. A funnel support frame 60 that surrounds the scoop funnel 50 serves as a handle for the scoop funnel 50.

Figure 7:
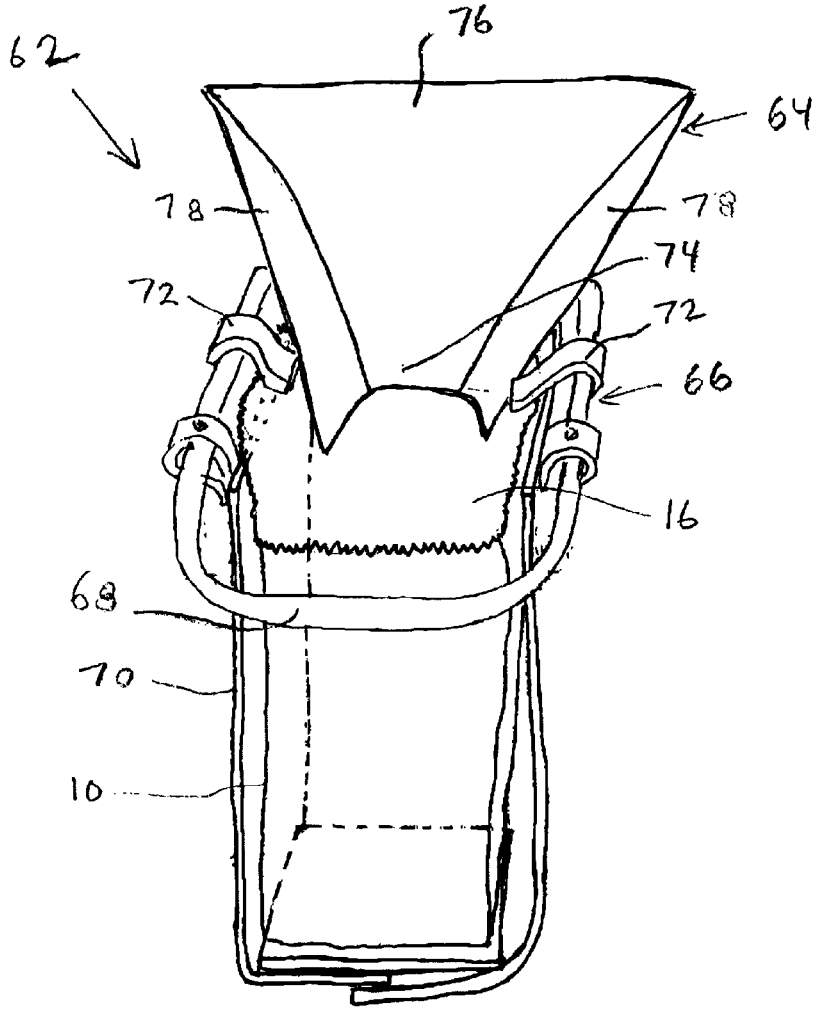
FIG. 7 is a perspective view of another embodiment of a collection apparatus in accordance with the present invention, wherein a scoop funnel is pivotally attached to a top portion of the main body of the collection apparatus.

FIG. 7 is a perspective view of another embodiment of a collection apparatus 62 in accordance with the present invention, wherein a scoop funnel 64 is pivotally attached to a top portion of the main body 66 of the collection apparatus 62. In this embodiment, the main body 66 comprises a rigid frame support 68, a solid walled collection bin 70, bag clamps 72 for maintaining the mouth 16 of a collection bag 10 in an open state, and a pivoting scoop funnel 64 for directing material into the collection apparatus 62. In order to carry the collection apparatus 62 from location to location, the rigid frame support 68 can serve as a handle. Alternately, wheels (not shown) may be secured to the bottom of the collection bin 70 as previously described with regard to the collection apparatus 2. As shown in FIG. 7, a collection bag 10 is positioned in the solid walled collection bin 70 and is clamped open by bag clamps 72. In this embodiment, the bag clamps are configured to be removably snapped onto the rigid frame support 68. However, the bag clamping flaps 22 used in conjunction with the collection apparatus 2 could also be used. The pivoting scoop funnel 64 is positioned such that the outlet 74 of the funnel 64 is located inside the collection bag 10, and the inlet 76 of the funnel 64 extends outward from the collection apparatus 62. The funnel 64 includes opposing side walls 78 for guiding collected material into the collection apparatus 62. When horizontally positioned on the ground or other surface, material to be collected can be directed through the funnel 64 into the collection bag 10. If a collection bag 10 is not used, material can be collected directly within the collection bin 70.

Figure 8:
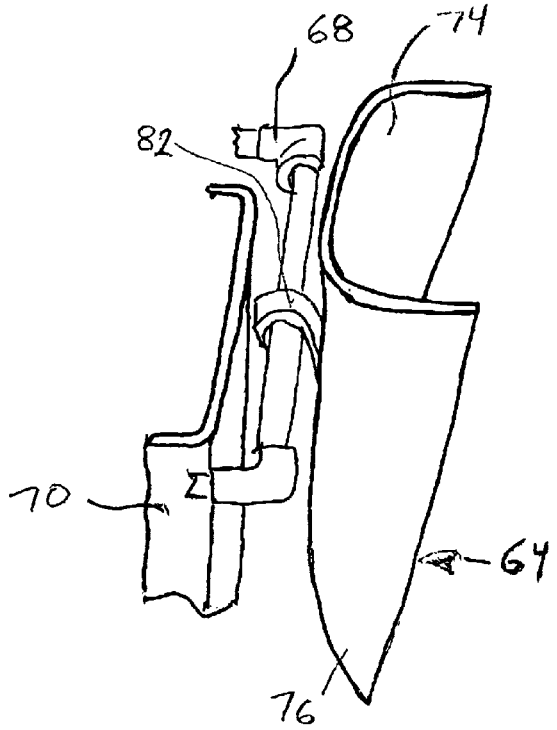
FIG. 8 is a perspective view of the scoop funnel of FIG. 7 with the scoop funnel pivoted outside the main body.

FIG. 8 shows the pivoting scoop funnel 64 of FIG. 7 pivoted out of the collection bin 70. When positioned in this manner, the collection bag 10 can be easily removed from the open front or top of the collection bin 70. As further illustrated in FIG. 8, the pivoting scoop funnel 64 is attached to the rigid frame support 68 by one or more pivoting brackets 82.

Figure 9:
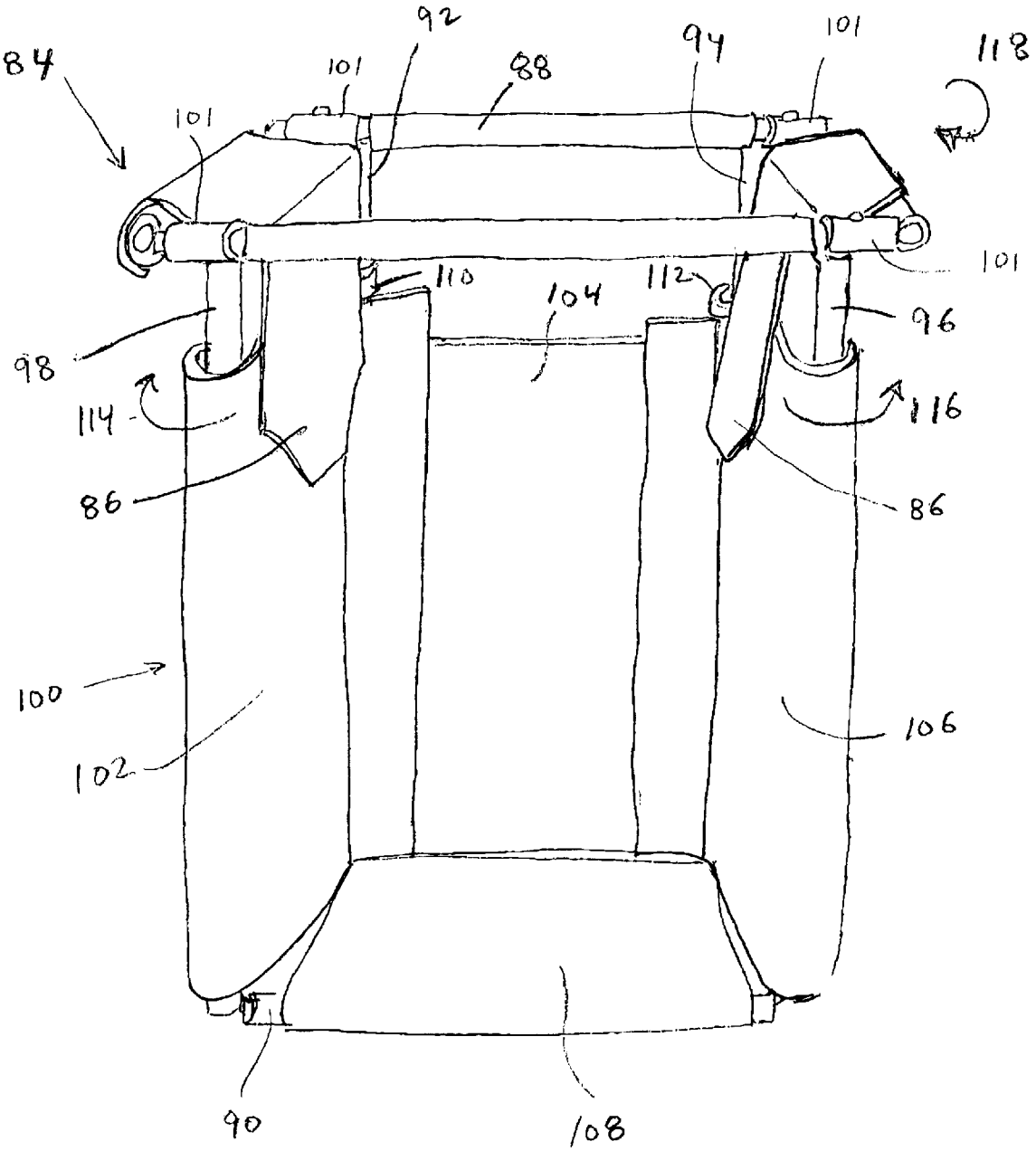
FIG. 9 is a perspective view of a collapsible collection apparatus in accordance with another embodiment of the present invention, wherein the main body of the collection apparatus can be folded flat for storage.

FIG. 9 is a perspective view of a collapsible collection apparatus in accordance with another embodiment of the present invention, wherein the main body 84 of the collection apparatus can be folded flat for storage. The main body 84 comprises an upper rotatable frame 88 connected to a lower rotatable frame 90 by four connecting frame members 92, 94, 96, 98. The upper and lower rotatable frames 88, 90 are rotatably received within a coupling 101 formed on the ends of the connecting frame members 92, 94, 96, 98. This allows the upper and lower rotatable frames 88, 90 to be rotated relative to the connecting frame members 92, 94, 96, 98 to collapse the main body 84.

The main body 84 further includes a collection bin 100 formed by a pivoting side wall 102, rear wall 104, pivoting side wall 106, and bottom wall 108. A collection bag (not shown) may be inserted into the collection bin 100. A plurality of removable clamping flaps 86 are provided to maintain the mouth of a collection bag in an open state by clamping opposing sides of the collection bag between the removable bag clamping flaps 86 and the pivoting side walls 102 and 106. Latches 110 and 112 are provided for removably fastening pivoting side walls 102 and 106 to the connecting frame members 92 and 94, respectively.

Figure 10:
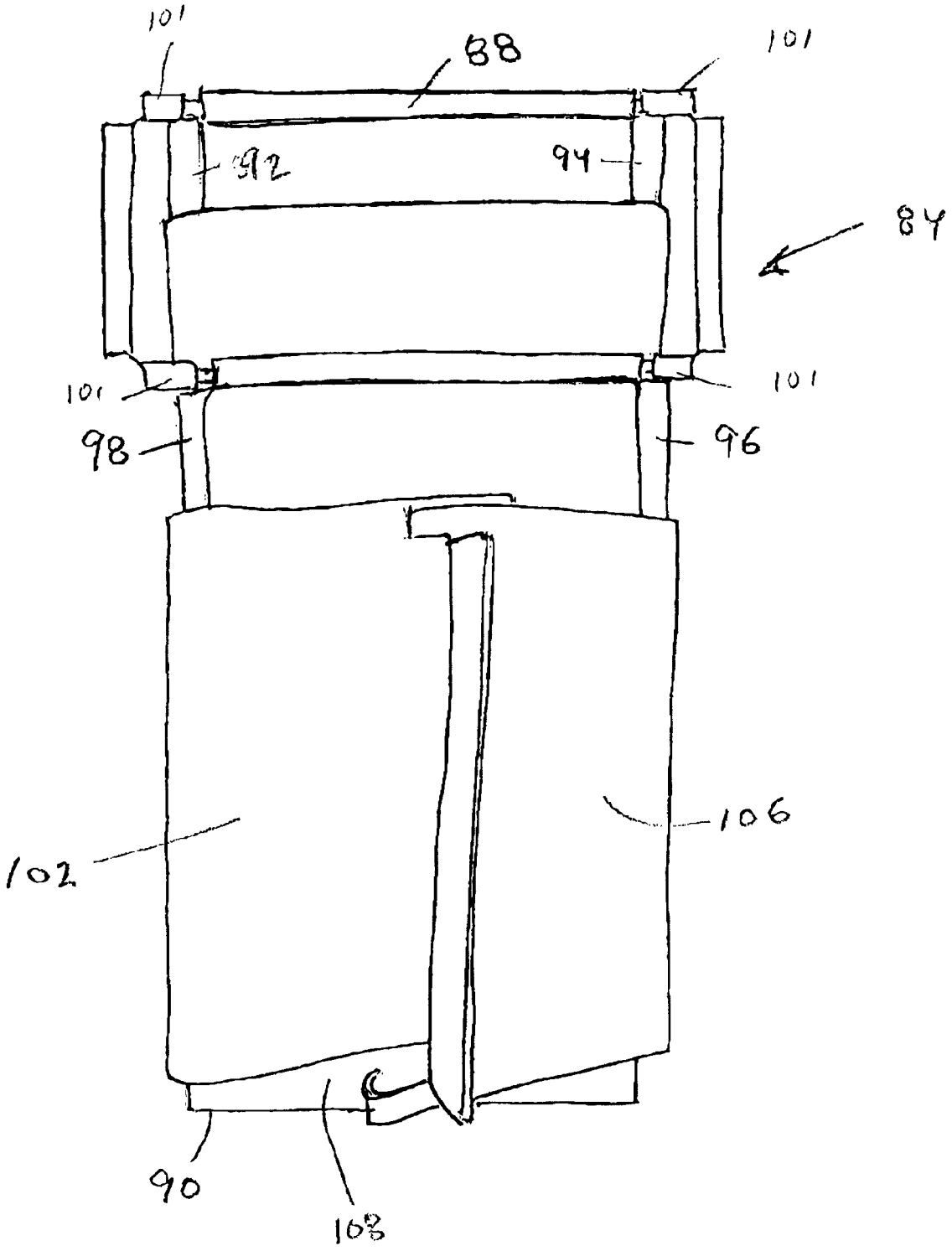
FIG. 10 illustrates the collection apparatus of FIG. 9 in a collapsed state.

FIG. 10 is a perspective view of the main body 84 of FIG. 9 folded flat for storage. Referring to FIGS. 9 and 10, a number of steps are performed to collapse the main body 84. First, the removable bag clamping flaps 86 are pulled off, or otherwise removed from, the upper rotatable frame 88. Second, the latches 110 and 112 are unfastened, releasing the pivoting side walls 102 and 106 from the connecting frame members 92 and 94. Third, the side wall 102 is rotated in a clockwise direction 114 and the side wall 106 is rotated in a counterclockwise direction 116. At this point, the upper rotatable frame 88 is rotated in direction 118 as illustrated in FIG. 9. Since the upper rotatable frame 88 is connected by the connecting frame members 92, 94, 96, 98 to the lower rotatable frame 90, the lower rotatable frame 90 (and attached bottom wall 108) will rotate an amount equal to that of the upper rotatable frame 88. Rotation is continued until the connecting frame members 92, 94, 96, 98 and the upper and lower rotatable frames 88, 90 essentially lie flat in the same plane. As a final step, the side walls 102 and 106 are rotated in reverse directions toward the bottom wall 108, thereby fully collapsing the main body 84.

Figure 11:
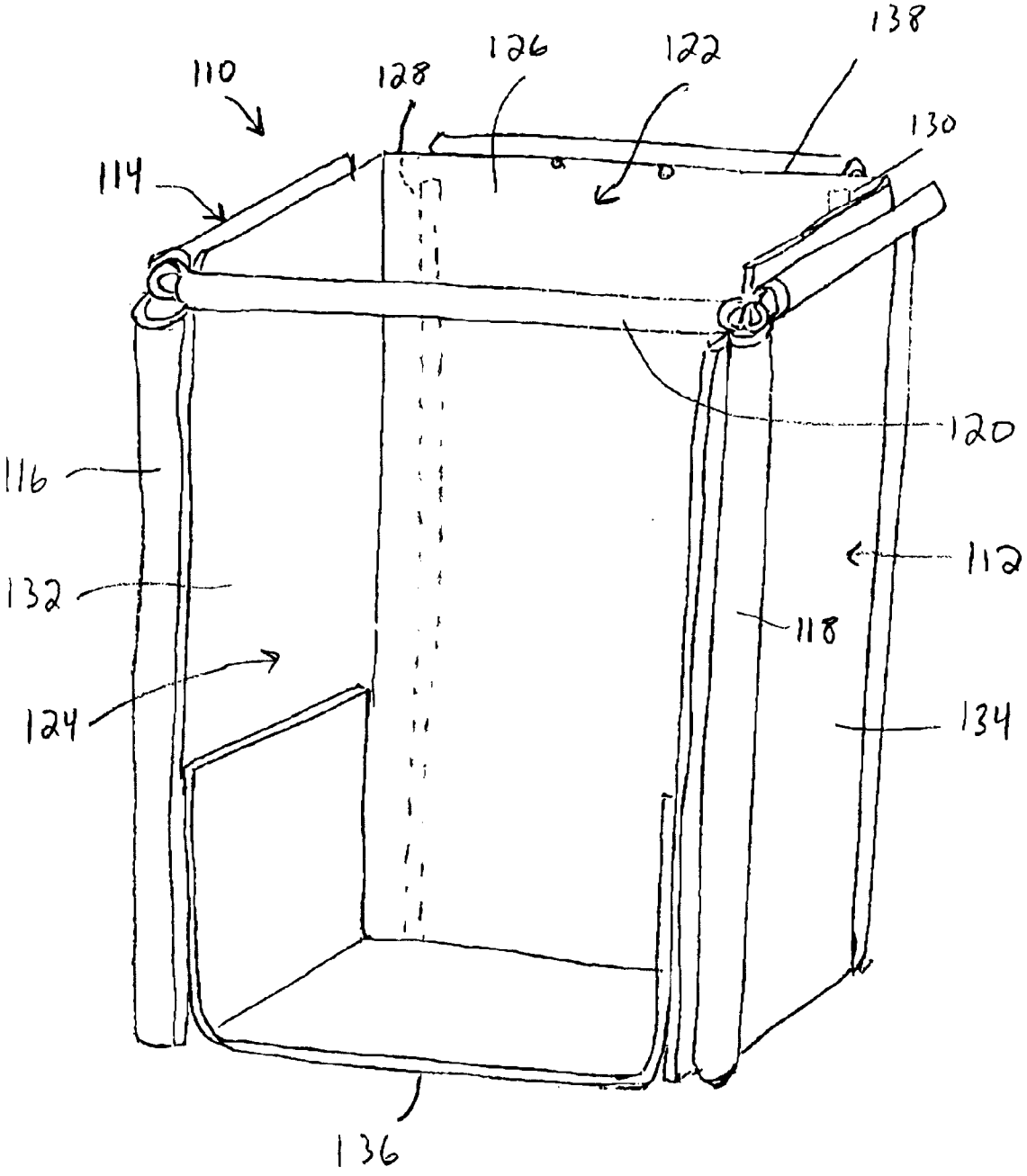
FIG. 11 is a front perspective view of a nestable collection apparatus in accordance with the present invention.

FIG. 11 is a front perspective view of a nestable collection apparatus in accordance with the present invention. The collection apparatus comprises a main body 110 including a solid walled collection bin 112 having a rigid frame 114 attached and surrounding the solid walled bin 112. The collection bin 112 includes a top opening 122, a front opening 124, side walls 132 and 134, bottom wall 136, and a rear wall 126. Side walls 132 and 134 taper outwardly with respect to each other from the rear wall 126 in order to facilitate the nesting of a plurality of the main bodies 110. The rigid frame 114 includes a handle member 120 that is removably fastened to frame members 116 and 118.

In use, the main body 110 may be rested on the ground with the rear wall 126 in contact with the ground. The main body 110 may then be pulled along the ground using the handle 120. Material may be scooped into the collection bin 112 through top opening 122 or through the front opening 124. A funnel, such as funnel 8 or funnel 50, may be used to direct material into the collection bin 112. A collection bag (not shown) may also be used.

Figure 12:
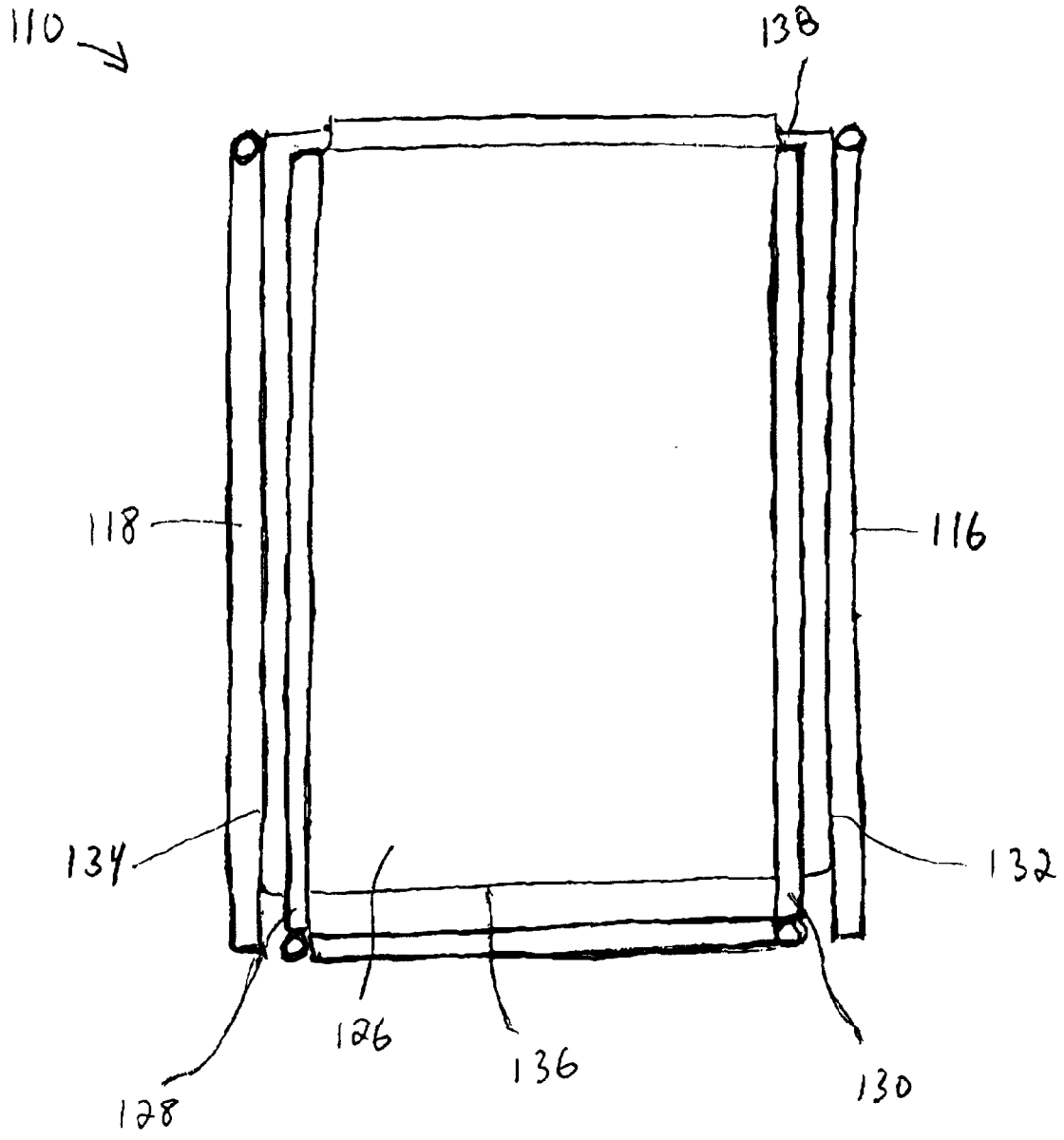
FIG. 12 is a rear elevational view of the collection apparatus of FIG. 11.

FIG. 12 is a rear perspective view of the main body 110 illustrating the inwardly recessed position of the rigid frame members 128 and 130 relative to the frame members 116 and 118 and side walls 132 and 134 of the collection bin 112. The rigid frame members 128 and 130 are attached to the outside of the rear wall 126. The ends of the rigid frame members 128, 130 closest to the bottom wall 136 protrude below the level of the bottom wall 136, while the other ends of the rigid frame members 128, 130 do not reach a top edge 138 of the real wall 126. This configuration allows a plurality of the main bodies 110 to be nested together. Specifically, after removing the removable handle member 120 from each of the main bodies 110, nesting is accomplished by sequentially inserting each main body 110 through the front opening 124 of a another main body 110.

Figure 13:
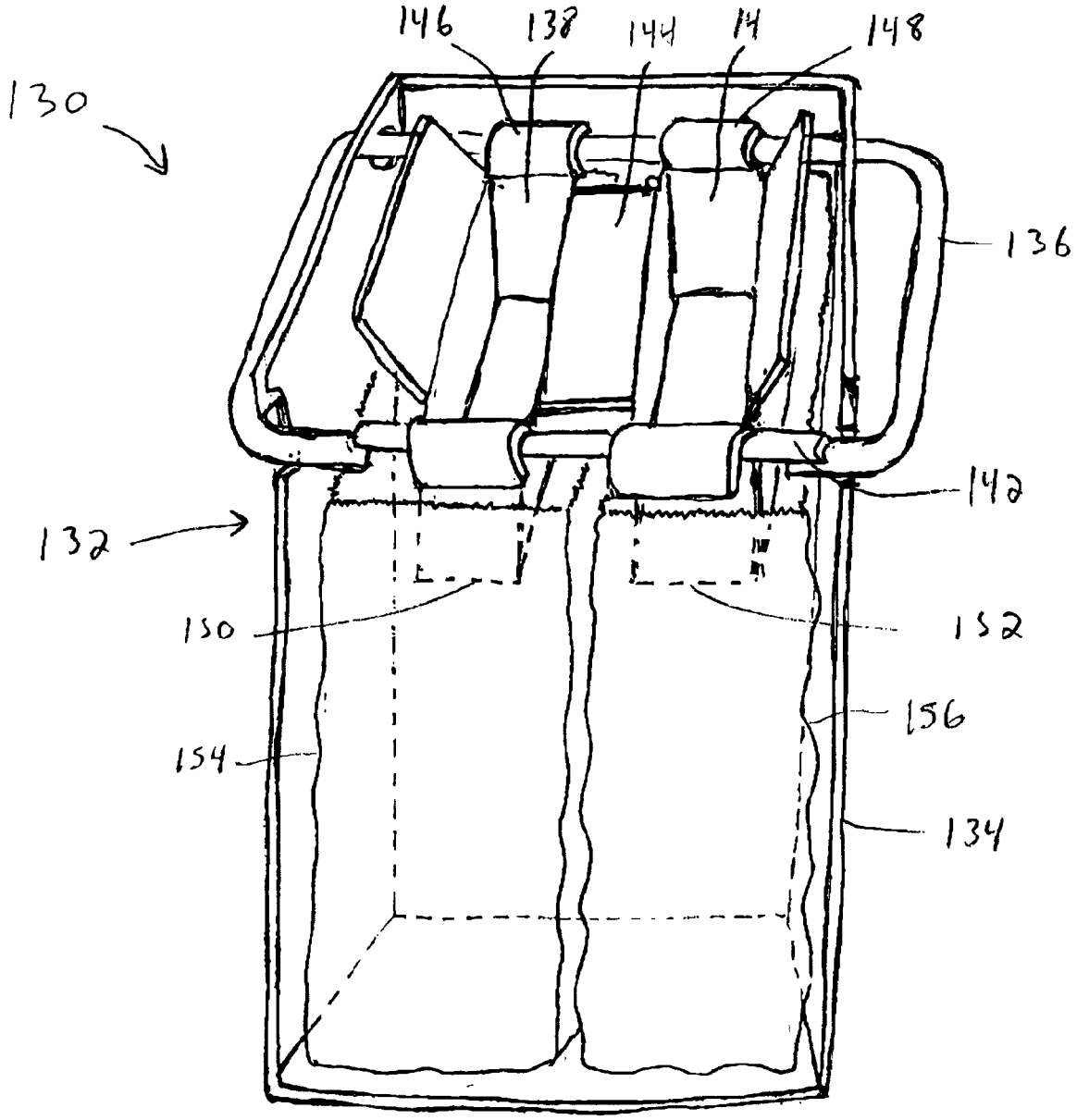
FIG. 13 is a front perspective view of another embodiment of a collection apparatus in accordance with the present invention, wherein the main body of the collection apparatus includes a pivoting support frame that supports two joined funnels.

FIG. 13 is a front perspective view of a another embodiment of a collection apparatus 130 in accordance with the present invention, wherein the main body 132 of the collection apparatus 130 includes a collection bin 134 and a funnel support frame 136 that supports two funnels 138, 140, joined by a front support member 142 and a plate 144, over the collection bin 134.

Figure 14:
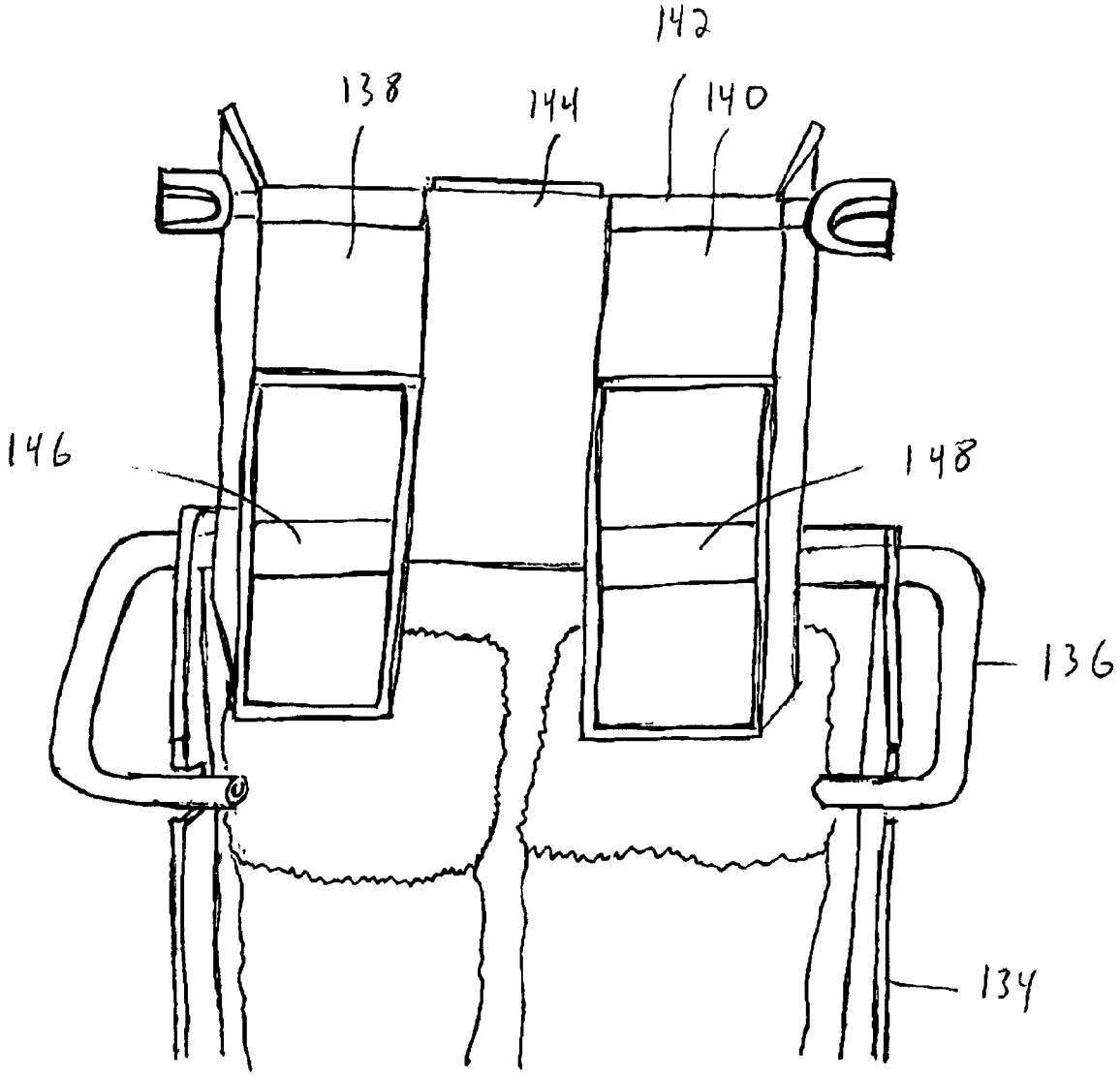
FIG. 14 is front perspective view of the upper portion of the main body of FIG. 14, wherein the funnels are pivoted in an upward direction to facilitate the insertion or removal of a plurality of collection bags from the collection apparatus.

The funnel assembly formed by the funnels 138, 140, support member 142 and plate 144, is configured to pivot about the funnel support frame 136 at support pivots 146 and 148. In FIG. 13, the funnel assembly has been rotated to a bag filling position wherein the outlets 150, 152 of the funnels 138, 140 are positioned within collection bags 154, 156 located within the collection bin 134. In this position, material deposited into the funnels 138 and 140 and is conveyed into the collection bags 154, 156. In FIG. 14, the funnel assembly has been rotated upward to a bag removal/insertion position.

The foregoing description of the present invention has been presented for purposes of illustration and description. It is not intended to be exhaustive or to limit the invention to the precise form disclosed, and many modifications and variations are possible in light of the above teaching. For example, the funnels of the present invention may be used together with other types of containers such as garbage cans, boxes, and the like for the collection of material. Such modifications and variations that may be apparent to a person skilled in the art are intended to be included within the scope of this invention as defined by the accompanying claims.

I/We claim:

1. An apparatus for collecting material comprising:

a main body, comprising a rigid frame support and a collection bin supported within the rigid frame support;

a collection bag positioned within the collection bin; and a funnel for directing material into the main body for collection, the funnel including an entrapment assembly for preventing collected material from escaping from the main body.

2. The apparatus according to claim 1, wherein the funnel further includes a funnel inlet, a funnel outlet, a pair of side walls extending from the funnel inlet toward the funnel outlet, a pair of side sealing flaps extending from the pair of side walls into a mouth of the main body, and a bottom sealing flap extending from the funnel outlet into the mouth of the main body.

3. The apparatus according to claim 1, wherein the entrapment assembly includes a first fixed flap and a second pivoting flap.

4. The apparatus according to claim 3, wherein the second pivoting flap is movable between a first position wherein material can be directed into the main body for collection, and a second position against the first fixed flap to prevent collected material from escaping from the main body.

5. The apparatus according to claim 3, wherein the funnel further includes a handle, and attachments for pivotally connecting the second pivoting flap to the handle.

6. The apparatus according to claim 1, further including a clamping assembly for maintaining a mouth of the collection bag in an open position within the collection bin.

7. The apparatus according to claim 6, wherein the clamping assembly comprises a plurality of bag clamping flaps, and a plurality of attachments for pivotally securing the bag clamping flaps to the rigid frame support.

8. The apparatus according to claim 6, wherein the clamping assembly comprises a plurality of bag clamping flaps which are configured to be removably snapped onto the rigid frame support.

9. The apparatus according to claim 1, further including a plurality of wheels attached to the main body.

10. The apparatus according to claim 9, wherein the wheels are in contact with a support surface when the main body is in a vertical position, and wherein the wheels do not contact the support surface when the main body is in a horizontal position for the collection of material.

11. An apparatus for collecting material comprising:

a main body;

a plurality of wheels attached to the main body, wherein the wheels are in contact with a support surface when the main body is in a vertical position, and wherein the wheels do not contact the support surface when the main body is in a horizontal position for the collection of material; and a funnel for directing material into the main body for collection, the funnel including an entrapment assembly for preventing collected material from escaping from the main body.

12. The apparatus according to claim 11, wherein the funnel further includes a funnel inlet, a funnel outlet, a pair of side walls extending from the funnel inlet toward the funnel outlet, a pair of side sealing flaps extending from the pair of side walls into a mouth of the main body, and a bottom sealing flap extending from the funnel outlet into the mouth of the main body.

13. The apparatus according to claim 11, wherein the entrapment assembly includes a first fixed flap and a second pivoting flap.

14. The apparatus according to claim 13, wherein the second pivoting flap is movable between a first position wherein material can be directed into the main body for collection, and a second position against the first fixed flap to prevent collected material from escaping from the main body.

15. The apparatus according to claim 13, wherein the funnel further includes a handle, and attachments for pivotally connecting the second pivoting flap to the handle.

16. The apparatus according to claim 11, wherein the main body comprises a frame and a collection bin supported within the frame.

17. The apparatus according to claim 16, further including a collection bag positioned within the collection bin.

18. The apparatus according to claim 17, further including a clamping assembly for maintaining a mouth of the collection bag in an open position within the collection bin.

19. The apparatus according to claim 18, wherein the clamping assembly comprises a plurality of bag clamping flaps, and a plurality of attachments for pivotally securing the bag clamping flaps to the frame.

20. The apparatus according to claim 18, wherein the clamping assembly comprises a plurality of bag clamping flaps which are configured to be removably snapped onto the frame.

* * * * *